US010910138B2

(12) United States Patent
Schnez et al.

(10) Patent No.: US 10,910,138 B2
(45) Date of Patent: Feb. 2, 2021

(54) GAS-INSULATED ELECTRICAL APPARATUS, IN PARTICULAR GAS-INSULATED TRANSFORMER OR REACTOR

(71) Applicant: ABB Power Grids Switzerland AG, Baden (CH)

(72) Inventors: Stephan Schnez, Zürich (CH); Vincent Dousset, Baden (CH); Roberto Zannol, Montegrotto Terme (IT); Rebei Bel Fdhila, Västerås (SE)

(73) Assignee: ABB Power Grids Switzerland AG, Baden (CH)

( * ) Notice: Subject to any disclaimer, the term of this patent is extended or adjusted under 35 U.S.C. 154(b) by 526 days.

(21) Appl. No.: 15/618,465

(22) Filed: Jun. 9, 2017

(65) Prior Publication Data

US 2017/0278616 A1 Sep. 28, 2017

Related U.S. Application Data

(63) Continuation of application No. PCT/EP2014/003341, filed on Dec. 12, 2014.

(51) Int. Cl.

| | |
|---|---|
| ***H01F 27/10*** | (2006.01) |
| ***H01F 27/18*** | (2006.01) |
| ***H01F 27/32*** | (2006.01) |

(52) U.S. Cl.

CPC ..... *H01F 27/18* (2013.01); *H01F 27/105* (2013.01); *H01F 27/321* (2013.01)

(58) Field of Classification Search

CPC ..... H01F 27/18; H01F 27/105; H01F 27/321

(Continued)

(56) References Cited

U.S. PATENT DOCUMENTS

| | | | |
|---|---|---|---|
| 3,201,728 | A | 8/1965 | McWhirter |
| 4,485,367 | A | 11/1984 | Hashizume |

(Continued)

FOREIGN PATENT DOCUMENTS

| | | | |
|---|---|---|---|
| CN | 87100199 | A | 9/1987 |
| CN | 1416146 | A | 5/2003 |

(Continued)

OTHER PUBLICATIONS

European Patent Office, International Search Report and Written Opinion issued in corresponding Application No. PCT/EP2014/003341, dated Oct. 9, 2015, 15 pp.

(Continued)

*Primary Examiner* — Alexander Talpalatski
*Assistant Examiner* — Joselito S. Baisa
(74) *Attorney, Agent, or Firm* — Sage Patent Group

(57) ABSTRACT

The present invention relates to gas-insulated electrical apparatuses, in particular gas-insulated transformers or reactors, comprising a housing enclosing an interior space, in which an electrical component comprising a winding is arranged, at least a portion of the interior space defining an insulation space which is filled with an insulation fluid electrically insulating at least a part of the electrical component from the housing. According to the invention, the electrical apparatus further comprises a cooling element comprising a condenser, an evaporator and a cooling fluid to be circulated between the condenser and the evaporator. The evaporator is designed such that at least a part of the electric component is immersed in the cooling fluid in its liquid state, thus being in direct contact with the cooling fluid.

27 Claims, 1 Drawing Sheet

(58) Field of Classification Search
USPC ..... 336/57, 58
See application file for complete search history.

(56) References Cited

U.S. PATENT DOCUMENTS

| | | | | |
|---|---|---|---|---|
| 8,245,512 | B2 * | 8/2012 | Schwiegel | C09K 5/045 252/67 |
| 8,709,303 | B2 | 4/2014 | Mahdizadeh et al. | |
| 8,816,808 | B2 * | 8/2014 | MacLennan | H01F 27/105 336/58 |
| 8,822,870 | B2 * | 9/2014 | Mantilla | H01B 3/56 218/118 |
| 8,916,059 | B2 * | 12/2014 | Glasmacher | H02B 13/055 252/67 |
| 9,373,346 | B1 * | 6/2016 | Bui | G11B 5/00813 |
| 2011/0267161 | A1 * | 11/2011 | MacLennan | H01F 27/105 336/58 |
| 2012/0085735 | A1 * | 4/2012 | Uchii | H01F 27/321 218/72 |
| 2012/0145521 | A1 * | 6/2012 | Glasmacher | H02B 13/055 200/293 |
| 2013/0277334 | A1 * | 10/2013 | Mantilla | H01B 3/56 218/85 |
| 2013/0285781 | A1 * | 10/2013 | Yin | H01F 27/12 336/58 |

FOREIGN PATENT DOCUMENTS

| | | | |
|---|---|---|---|
| CN | 103415895 | A | 11/2013 |
| CN | 103430244 | A | 12/2013 |
| JP | S56101721 | A | 8/1981 |
| JP | S56107538 | A | 8/1981 |
| JP | S5860512 | A | 4/1983 |
| JP | S58060512 | A | 4/1983 |
| JP | S61111513 | A | 5/1986 |
| WO | 2011029488 | A1 | 3/2011 |
| WO | 2011048039 | A2 | 4/2011 |
| WO | 2011048039 | A3 | 4/2011 |
| WO | 2016091273 | A1 | 6/2016 |

OTHER PUBLICATIONS

European Patent Office, International Preliminary Report on Patentability issued in corresponding Application No. PCT/EP2014/003341, dated Nov. 14, 2016, 21 pp.

The State Intellectual Property Office of the People's Republic of China, First Office Action issued in corresponding Chinese application No. 201480084651.1, dated Sep. 3, 2018, 13 pp.

National Intellectual Property Administration, "English Translation of Second Chinese Office Action & Search Report", dated May 5, 2019, 15 Pages. Chinese Patent Office.

Chinese Fourth Office Action dated Jun. 22, 2020 for Chinese Patent Application No. 201480084651.1, 12 pages (including English translation).

* cited by examiner

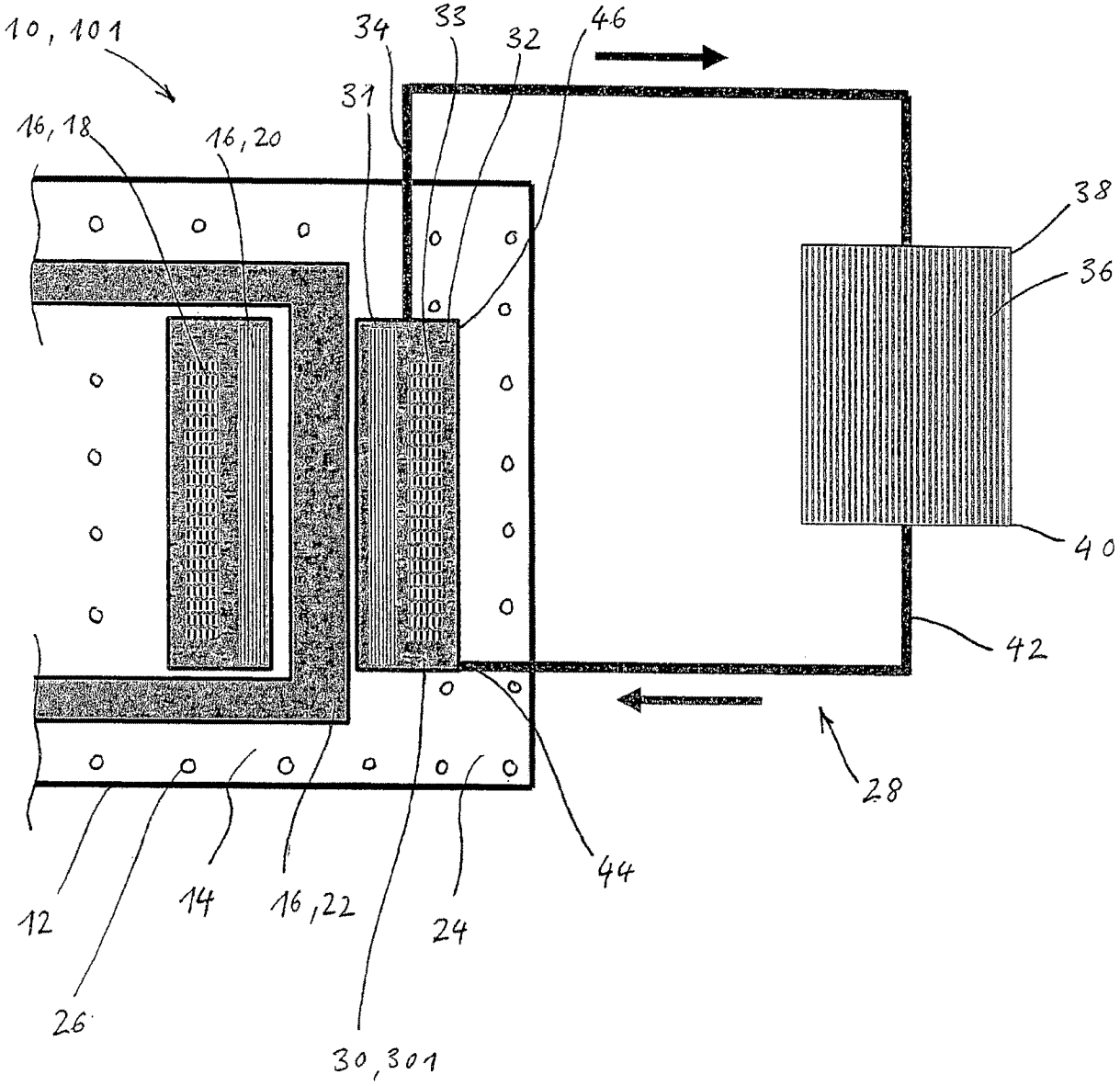
38
36
40
42
28
46
32
33
34
37
44
24
30,301
16,22
14
26
12
16,20
16,18
10,101

GAS-INSULATED ELECTRICAL APPARATUS, IN PARTICULAR GAS-INSULATED TRANSFORMER OR REACTOR

The present invention relates to a gas-insulated electrical apparatus according to claim 1, in particular to a gas-insulated transformer or gas-insulated reactor.

Transformers and reactors are well known in the art. Generally, a transformer designates a device that transfers electrical energy from one circuit to another through inductively coupled conductors, i.e. the transformer windings. A current in the first ("primary") winding creates a magnetic field in a magnetic core, said magnetic field inducing a voltage in the second ("secondary") winding. This effect is called mutual induction. A reactor within the meaning of the present invention designates an inductor used to block high-frequency alternating current in an electrical circuit, while allowing lower frequency or direct current to pass. In contrast to a transformer, which in any case comprises at least two windings, a reactor can comprise one single winding.

The active parts of the electrical component of the transformer or reactor, which among other parts comprise the winding(s) and optionally the magnetic core, must be insulated from each other depending on the dielectric requirements between them. With regard to the insulation, different types of transformers (or reactors in analogy) can be distinguished:

In a dry transformer (or reactor, respectively), on the one hand, the electrical component comprising the windings and the magnetic core is not immersed in an insulating fluid; typically, it is surrounded by air at atmospheric pressure or is cast in epoxy resin.

In a liquid- or gas-insulated transformer, on the other hand, the electrical component is arranged in a tank or vessel, which is filled with an insulation fluid. In a liquid-insulated transformer the insulation fluid is a liquid, such as mineral oil or silicone oil or ester oil, whereas in a gas-insulated transformer the insulation fluid is a gas, such as $SF_6$ or $N_2$ either at atmospheric or elevated pressure.

For a voltage higher than 36 kV, gas- or liquid-insulated transformers are typically used. Due to the relatively high insulating performance and the high thermal performance of the insulation fluid, the clearance between the parts of the electrical component is relatively small compared to dry transformers.

However, liquid-insulated transformers, and in particular oil-immersed transformers, bear a risk of fire and explosion under severe fault conditions. This can be critical in sensitive areas, such as underground substations, urban areas, refineries and offshore-installations. In such cases, gas-insulated transformers filled with a non-flammable gas are preferably used for safety reasons. For example, transformers using $SF_6$ as insulation gas have become available on the market.

In the attempt of finding an alternative insulation fluid having a high insulation performance and having at the same time a Global Warming Potential (GWP) lower than $SF_6$, the use of a fluoroketone in a transformer has been suggested e.g. in WO 2011/048039.

Despite of the high efficiency of transformers, there is often the case that substantial losses up to more than 100 kW have to be dissipated. In liquid-insulated transformers, and in particular in oil-immersed transformers, this task is generally met, since the insulation liquid, in particular the oil, has a relatively high cooling efficiency. Depending on the power level, natural or forced convection can be applied.

However, in the case of gas-insulated transformers the thermal performance is strongly limited, primarily due to the much lower density of the gas in comparison to a liquid. In the case of an $SF_6$-insulated transformer, this can be at least partially overcome by increasing the operating pressure and hence the density of $SF_6$, thereby increasing the cooling efficiency of the insulation fluid.

For the fluoroketones suggested in WO 2011/048039, this possibility is limited due to the higher condensation temperature of the fluoroketones compared to the one of $SF_6$.

The use of a fluoroketone for cooling of a preferably dry-type transformer having disc windings has been suggested in WO 2011/029488. Therein, a transformer is disclosed which comprises at least one heat pipe for dissipating heat energy from the coil of the transformer, said heat pipe comprising at least one heat pipe evaporator positioned between the low voltage and the high voltage coils. By the specific positioning of the heat pipe evaporator, the transformer according to WO 2011/029488 aims at combining the advantages of the cooling by a heat pipe with the advantages of casting the electrical active parts in a material having a high dielectric performance.

Nevertheless, there is an ongoing need for efficient dissipation of heat losses generated in an electrical apparatus, in particular a fluid-insulated transformer, if a non-$SF_6$ fluid is used as insulation fluid.

In consideration of this, the problem to be solved by the present invention is to provide a fluid-insulated electrical apparatus, in particular gas-insulated electrical apparatus, which allows for an efficient dissipation of heat losses generated in the electrical components of the apparatus also when using an insulation fluid having a relatively low condensation temperature.

In particular, a fluid-insulated and preferably gas-insulated transformer shall be provided, which even in the case that an organofluorine compound is used in the insulation fluid, allows for an efficient dissipation of heat losses generated in the windings and/or the magnetic core of the transformer.

The problem is solved by the fluid-insulated and preferably gas-insulated electrical apparatus and by the cooling method defined in the independent claims. Preferred embodiments of the invention are given in the dependent claims.

According to the invention, the fluid-insulated and preferably gas-insulated electrical apparatus comprises a housing enclosing an interior space, in which an electrical component comprising at least one winding is arranged, at least a portion of the interior space defining an insulation space which is filled with an insulation fluid electrically insulating at least a part of the electrical component from the housing.

The electrical apparatus further comprises a cooling element comprising a condenser, an evaporator and a cooling fluid to be circulated between the condenser and the evaporator. The evaporator is designed such that at least a part of the electrical component is immersed in the cooling fluid in its liquid state, thus being in direct contact with the cooling fluid.

Due to the cooling fluid being liquid and in direct contact with the electrical component, a very efficient cooling can be achieved. This is on the one hand owed to the fact that heat is transferred directly to the cooling fluid by heat conduction, as opposed to e.g. the technology disclosed in WO 2011/029488 by which heat is transferred indirectly, specifically over a casting resin, onto a heat pipe working medium, and as further opposed to a conventional apparatus in which cooling is achieved by convection only, be it by natural or forced convection. On the other hand, the very high cooling efficiency obtained by the present invention is owed to the high amount of heat adsorbed during the phase transition from the liquid to the gaseous state of the cooling fluid, i.e. by using the heat of evaporation of the cooling fluid.

The term "in direct contact" is to be interpreted such that there is no intermediate layer between the electrical component itself and the cooling fluid at the contacting region. In particular, the term is to be interpreted that there is no casting resin present between the electrical component and the cooling fluid at the contact surface. In the case where the term electrical component refers to one or more windings of a transformer, the term "electrical component" includes any winding insulation layer, specifically a paper layer or the like, applied on the surface of the windings.

Thus, a winding comprising a winding insulation layer, specifically a paper layer or the like, applied thereon and being with said winding insulation layer in direct contact with the cooling fluid shall be interpreted to be "in direct contact with the cooling fluid".

The term "at least a part of the electrical component" is thereby to be interpreted such that embodiments are encompassed in which only parts of the electrical component, in particular the at least one winding and/or the magnetic core, is immersed in the cooling fluid as well as embodiments, in which the electrical component is fully immersed.

In embodiments, the cooling fluid is a dielectric insulating material. In other embodiments, the immersed part of the electrical component is a bare or barely insulated part producing heat upon exposure to electric or magnetic fields, in particular a bare or barely insulated current-carrying or voltage-carrying conductive part or metallic part or conductor or winding or magnetic core, of the electrical component.

Thus, in other words as stated above, at least a part of the electrical component is immersed in the cooling fluid in its liquid state such that a direct contact between the bare or barely insulated current-carrying or voltage-carrying conductive part—in general part producing heat upon exposure to electric or magnetic fields—, in particular metallic part or conductor or winding or magnetic core, of the electric component and the dielectrically insulating cooling fluid in its liquid state is achieved. Herein, "bare" shall mean bare from dielectric insulation such as cast resin or thermally insulating coatings, and "barely insulated" shall allow for at most thin coatings with only insignificant thermal insulation properties. Such immersion being immediate or substantially immediate avoids any or substantially any intermediate material between the conductive parts of the electrical component and the dielectrically insulating liquid cooling fluid and thus allows for very efficient heat transfer from the immersed part of the electrical component to the immersing liquid cooling fluid. In particular, the heat transfer is effected via heat conduction from hotter part to colder fluid, and/or via heat convection by flow of the liquid cooling fluid, and/or via latent heat absorption via phase transition and particularly evaporation of the liquid cooling fluid.

In embodiments, means for creating a turbulent flow of the liquid cooling fluid inside the cooling element, in particular inside the evaporator and particularly around the immersed part of the electrical component, are present. Such means may be or be part of the immersed part of the electrical component itself. This allows to increase the heat transfer to the liquid cooling fluid. Such turbulent flow is different from and advantageous over conventional heat pipes having laminar flow and thus less efficient heat transfer performance.

The present invention allows a relatively simple adaptation of conventional apparatus designs, in particularly existing transformer designs, by merely adding the specific cooling element. No reconstruction of e.g. the windings of transformers are necessary, as opposed to the technology disclosed in U.S. Pat. No. 8,436,706 which requires the spiral windings to be a hollow copper tubing through which a refrigerant is to be passed.

Specifically, the cooling element of the present invention is a heat sink.

In that the cooling element comprises an evaporator and a condenser, its function is similar to the one of a heat pipe. According to a specific embodiment, the cooling element is a heat pipe.

According to a specific embodiment, the apparatus is a gas-insulated transformer, the electrical component of which comprising at least two windings including a primary winding and a secondary winding and further comprising a magnetic core. In this context, embodiments are encompassed in which at least a part of at least one winding is immersed in the cooling fluid and/or embodiments in which at least a part of the magnetic core is immersed in the cooling fluid. Further, embodiments are encompassed in which at least one winding and/or the magnetic core are fully immersed in the cooling fluid.

Embodiments, in which at least one winding is at least partially immersed in the cooling fluid in its liquid state, are particularly preferred. This is due to the fact that the highest hotspot temperatures are to be expected in the windings, which can be efficiently cooled by immersion in the liquid cooling fluid.

According to a further preferred embodiment, the insulation fluid and the cooling fluid differ from each other in their composition and/or density. This allows the respective medium or its function to be optimized to the actual needs. In particular, a composition and/or density can be chosen for the cooling fluid in which its condensation temperature is lower than the condensation temperature of the insulation fluid. Thus, immersion of the electrical component in the cooling fluid being in its liquid state can be achieved, while the insulation fluid is at least partially, preferably completely, kept in the gaseous state.

More particularly, the composition of the cooling fluid is chosen such that it evaporates and condenses at a predetermined temperature and a predetermined pressure. In this regard, the predetermined temperature is dependent on the operational temperature of the apparatus and the hotspot temperature of the electrical component, and the predetermined pressure is within the limits of the pressure-vessel ratings.

According to a specifically preferred embodiment, the cooling fluid has a boiling point lower than the maximally allowed hotspot temperature at the at least one winding, in particular the immersed part of the at least one winding. By evaporation of the cooling fluid at the hotspot, specifically efficient heat dissipation is achieved.

Particularly, the cooling fluid has a boiling point lower than 100° C., preferably lower than 50° C., and most preferably lower than 30° C. at the maximum pressure expected inside the electrical apparatus, in particular inside the cooling element, during standard operation of the electrical apparatus. Typically, the maximum pressure expected inside the electrical apparatus, in particular inside the cooling element, during standard operation of the electrical apparatus is 6 bar at most, specifically 3 bar at most, more specifically 1.5 bar at most, and most specifically is about 1 bar.

It is particularly preferred that the cooling fluid and/or the insulation fluid comprises independently from each other an organofluorine compound, in particular selected from the group consisting of fluoroethers, in particular hydrofluoromonoethers, fluoroketones, in particular perfluoroketones, fluoroolefins, in particular hydrofluoroolefins, and fluoronitriles, in particular perfluoronitriles, and mixtures thereof.

By the term "and/or" embodiments are encompassed in which either the insulation fluid or the cooling fluid or both the insulation fluid and the cooling fluid comprises an organofluorine compound.

In this regard, it is particularly preferred that the cooling fluid and/or the insulation fluid comprises a fluoroketone containing from four to twelve carbon atoms, preferably containing exactly five carbon atoms or exactly six carbon atoms, or a mixture thereof. A more detailed description of the respective fluoroketones is for example given in WO 2014/053661 A1 or WO 2012/080246 A1, the disclosure of which is hereby incorporated by reference.

According to a further embodiment, the cooling fluid and/or the insulation fluid comprises a hydrofluoromonoether containing at least three carbon atoms. A more detailed description of the respective hydrofluoromonoethers is for example given in WO 2014/053661 A1 or WO 2012/080222 A1, the disclosure of which is hereby incorporated by reference.

As mentioned above, the organofluorine compound can also be a fluoroolefin, in particular a hydrofluoroolefin. More particularly, the fluoroolefin or hydrofluoroolefin, respectively, contains exactly three carbon atoms.

According to particularly preferred embodiments, the hydrofluoroolefin is thus selected from the group consisting of: 1,1,1,2-tetrafluoropropene (HFO-1234yf), 1,2,3,3-tetrafluoro-2-propene (HFO-1234yc), 1,1,3,3-tetrafluoro-2-propene (HFO-1234zc), 1,1,1,3-tetrafluoro-2-propene (HFO-1234ze), 1,1,2,3-tetrafluoro-2-propene (HFO-1234ye), 1,1,1,2,3-pentafluoropropene (HFO-1225ye), 1,1,2,3,3-pentafluoropropene (HFO-1225yc), 1,1,1,3,3-pentafluoropropene (HFO-1225zc), (Z)1,1,1,3-tetrafluoropropene (HFO-1234zeZ), (Z)1,1,2,3-tetrafluoro-2-propene (HFO-1234yeZ), (E)1,1,1,3-tetrafluoropropene (HFO-1234zeE), (E)1,1,2,3-tetrafluoro-2-propene (HFO-1234yeE), (Z)1,1,1,2,3-pentafluoropropene (HFO-1225yeZ), (E)1,1,1,2,3-pentafluoropropene (HFO-1225yeE), and combinations thereof.

As mentioned above, the organofluorine compound can also be a fluoronitrile, in particular a perfluoronitrile. In particular, the organofluorine compound can be a fluoronitrile, specifically a perfluoronitrile, containing two carbon atoms, three carbon atoms or four carbon atoms.

More particularly, the fluoronitrile can be a perfluoroalkylnitrile, specifically perfluoroacetonitrile, perfluoro-propionitrile ($C_2F_5CN$) and/or perfluorobutyronitrile ($C_3F_7CN$).

Most particularly, the fluoronitrile can be perfluoroisobutyronitrile (according to the formula $(CF_3)_2CFCN$) and/or perfluoro-2-methoxypropanenitrile (according to the formula $CF_3CF(OCF_3)CN$). Of these, perfluoroisobutyronitrile is particularly preferred due to its low toxicity.

According to a very straightforward embodiment, both the cooling fluid and the insulation fluid comprise the same organofluorine compound. It is, however, understood that this has not necessarily to be the case. Thus, embodiments are explicitly encompassed in which the cooling fluid and the insulation fluid comprise different organofluorine compounds.

According to a further preferred embodiment, the evaporator is surrounded by the insulation space and comprises an evaporator wall enclosing an evaporator interior space separated from the insulation space, said evaporator wall being impermeable for both the insulation fluid and the cooling fluid. Thus, the cooling fluid is confined to a volume where it is actually needed to fulfil its function. The possibility to confine the cooling fluid to a relatively small volume is particularly desirable from an economic point of view, given the fact that density of the liquid cooling fluid is much higher than that of the gaseous insulation fluid and that the cost of the cooling fluid per volume unit is, thus, generally higher than the one of the insulation fluid.

According to a specific embodiment of the present invention, the cooling fluid is at least approximately devoid of a background gas, such as air or an air component, and preferably essentially consists of an organofluorine compound or a mixture of organofluorine compounds. This preferred composition is owed to the primary function of the cooling fluid to dissipate heat.

In contrast thereto, the insulation fluid preferably comprises an organofluorine compound in combination with a background gas, in particular selected from the group consisting of air, an air component, nitrogen, oxygen, carbon dioxide, a nitrogen oxide, and mixtures thereof. This preferred composition is owed to the primary function of the insulation medium to provide a high dielectric strength and to prevent liquefaction at the same time.

It is further preferred that the pressure of the cooling fluid in the evaporator is below 1.5 bar, and preferably is at least approximately identical to the pressure of the insulation fluid in the insulation space. Thus, only a very moderate differential pressure has to be withstood by the evaporator wall and no specific requirements with regard to its mechanical strength are thus required.

As mentioned, the cooling element of the present invention comprises a condenser. Typically, the evaporator is fluidically connected to the condenser by a cooling fluid outlet channel, designed to allow a flow of the evaporated cooling fluid from the evaporator in direction to the condenser, as will be shown in connection with the attached FIGURE.

As a rule, the condenser is designed to transfer heat to the outside of the apparatus, and preferably is arranged outside of the apparatus. According to specific embodiment, an auxiliary cooling element is allocated to the condenser, specifically a convection cooler and/or a water cooler. This allows improving the efficiency of the condenser, i.e. a high heat transfer rate from the condenser to the environment.

As will be further shown in connection with the attached FIGURE, the condenser and the evaporator are in general fluidically connected by a cooling fluid recirculation channel, designed to allow a flow of the condensed cooling fluid from the condenser in direction to the evaporator. According to a specific embodiment, the cooling fluid outlet channel and the cooling fluid recirculation channel can be formed of one and the same channel. In this regard, the flow of evaporated cooling fluid from the evaporator to the condenser and the flow of liquid cooling fluid from the condenser to the evaporator take place in the same channel or pipe.

In its proximal region (or cooling fluid outlet region) branching off from the condenser, the cooling fluid recirculation channel is preferably arranged outside of the apparatus. By this design, the condensed cooling fluid which flows down the recirculation channel can be kept in liquid phase, given the relatively low temperature of the apparatus' environment.

Typically, the cooling fluid recirculation channel enters the evaporator in its bottom region. Thereby, the condensed cooling fluid is merged with the cooling fluid contained in the evaporator, thus closing the recirculation cycle.

According to a specific embodiment, a pump, such as a suction pump, is provided for generating the flow of the fluid. The pump can e.g. be allocated to the cooling fluid outlet channel, the condenser and/or the cooling fluid recirculation channel. Alternatively or additionally, a compressor can be provided, which further allows active cooling of the interior space.

The evaporator interior space can be adapted to the specific design of the transformer. In a transformer comprising disc windings, the evaporator interior space can for example comprise multiple evaporator interior space segments fluidically connected with one another, each of the segments being attributed to a disc winding of the transformer.

In addition to the apparatus disclosed above, the present invention further relates to a method or process for cooling an electrical component of an electrical apparatus, comprising the method elements of a) transferring heat in an evaporator from the electrical component to a cooling fluid, at least a portion of which being in its liquid state and in which at least a part of the electrical component is immersed, whereby at least a portion of the liquid cooling fluid evaporates, b) transferring the evaporated cooling fluid generated in step a) to a condenser, where the evaporated cooling fluid is cooled down below the condensation temperature, thereby becoming liquid, and c) transferring the liquid cooling fluid obtained in step b) back to the evaporator.

In embodiments, a turbulent flow of the liquid cooling fluid inside the cooling element, in particular inside the evaporator and particularly around the immersed part of the electrical component, is created. This allows to increase the heat transfer to the liquid cooling fluid, in particular compared to conventional heat pipes providing laminar flow of the working fluid.

As discussed in respect of the apparatus of the present invention, the process allows a very efficient cooling of the electrical component, which on the one hand is owed to the fact that heat sources (optionally including a winding insulation layer) are in direct contact with the cooling fluid yielding a very efficient heat transfer, and, on the other hand, by the high amount of heat absorbed by the phase transition of the cooling fluid.

It is understood that any feature disclosed above as being a preferred feature of the apparatus, is also disclosed as a preferred feature of the process of the present invention, and vice versa.

The invention is further illustrated by the attached

FIG. 1 showing a purely schematic sectional view of a gas-insulated electrical apparatus of the present invention.

The gas-insulated electrical apparatus 10 shown in FIG. 1 is in the form of a gas-insulated transformer 101 comprising a housing 12 enclosing an interior space 14, in which an electrical component 16 comprising a primary, low-voltage winding 18 and a secondary, high voltage winding 20 is arranged.

In the specific embodiment shown, the windings 18, 20 are arranged concentrically and are wound around a magnetic core 22 designed in the "core form".

The interior space 14 of the transformer 101 defines an insulation space 24 which is filled with an insulation fluid 26 electrically insulating the windings 18, 20 and the core 22 from the housing 12. In the embodiment shown, the insulation fluid is in its gaseous state. However, also two-phase systems, in which at least some of the components are partially present in liquid phase apart from the gaseous phase, are thinkable.

The transformer 101 further comprises a cooling element 28 which comprises an evaporator 30.

In the embodiment shown, the evaporator 30 is in the form of an encapsulation 301 in which the windings 18, 20 are enclosed. Specifically, the evaporator 30 is surrounded by the insulation space 24 and comprises an evaporator wall 31 enclosing an evaporator interior space 33 separated from the insulation space 24.

Specifically, the encapsulation 301 is in the form of a hollow cylinder arranged around the magnetic core 22, the axis of the hollow cylinder running parallel to the respective portion of the magnetic core 22.

The evaporator interior space 33 has a volume which is only slightly greater than the volume defined by the outer contour of the windings 18, 20 and is filled with a cooling fluid 32, which is at least partially in its liquid state. In embodiments, the evaporator wall 31 is impermeable for both the insulation fluid 26 and the cooling fluid 32.

In its uppermost region 46, the evaporator 30 opens into a cooling fluid outlet channel 34, which extends from the interior space 14 of the transformer 101 through the housing 12 to the outside and fluidically connects the evaporator 30 with a condenser 36 arranged outside of the housing 12. Specifically, the cooling fluid outlet channel 34 enters the condenser 36 in its uppermost region 38. In its bottom region 40, the condenser 36 opens into cooling fluid recirculation channel 42 extending again into the interior space 14 of the transformer 101, where it enters the evaporator 30 in its bottom region 44.

In operation, the liquid cooling fluid, which is in direct contact with the windings 18, 20 immersed therein, is heated by the losses generated in the windings. When reaching the evaporation temperature, the cooling fluid 32 enters the gaseous state. The evaporated cooling fluid thereby formed is emitted into the cooling fluid outlet channel 34, by means of which it is transferred into the condenser 36.

Upon entering the condenser 36, the evaporated cooling fluid is cooled down below the condensation temperature, thereby becoming liquid again. The resulting cooling fluid liquid is then again transferred to the evaporator 30 by means of the cooling fluid recirculation channel 42, thus closing the recirculation cycle.

LIST OF REFERENCE NUMERALS

10; 101 fluid-insulated electrical apparatus, gas-insulated electrical apparatus; gas-insulated transformer, gas-insulated reactor
12 housing
14 interior space
16 electrical component
18 primary winding
20 secondary winding
22 magnetic core
24 insulation space
26 insulation fluid

28 cooling element
30 evaporator
31 evaporator wall
32 cooling fluid
33 evaporator interior space
34 cooling fluid outlet region, cooling fluid evaporator-outlet channel
36 condenser
38 uppermost region of the condenser
40 bottom region of the condenser
42 cooling fluid recirculation channel
44 bottom region of the evaporator, cooling fluid evaporator-inlet channel
46 uppermost region of the evaporator

The invention claimed is:

1. A fluid-insulated electrical apparatus, comprising:

a housing enclosing an interior space, in which interior space an electrical component comprising at least one winding is arranged, at least a portion of the interior space defining an insulation space;

an insulation fluid disposed within the insulation space and electrically insulating at least a part of the electrical component from the housing, the insulation fluid comprising a first organofluorine compound and a background gas, wherein the first organofluorine compound is selected from the group consisting of fluoroethers, fluoroketones, fluoroolefins, fluoronitriles, and mixtures thereof;

a cooling element comprising a condenser, an evaporator and a cooling fluid to be circulated between the condenser and the evaporator, the evaporator being configured such that at least a part of the electrical component is immersed in the cooling fluid in its liquid state, thus being in direct contact with the cooling fluid, the cooling fluid consisting of second organofluorine compound selected from the group consisting of fluoroethers, fluoroketones, fluoroolefins, fluoronitriles, and mixtures thereof, wherein the cooling fluid is devoid of a background gas, wherein the insulation fluid has a first condensation temperature and the cooling fluid has a second condensation temperature lower than the first condensation temperature.

2. The electrical apparatus according to claim 1, further comprising a fluid-insulated transformer, the electrical component comprising:

at least two windings including a primary winding and a secondary winding; and a magnetic core.

3. The electrical apparatus according to claim 2, wherein at least one winding of the at least two windings is at least partially immersed in the cooling fluid in its liquid state.

4. The electrical apparatus according to claim 1, wherein the insulation fluid and the cooling fluid differ from each other in at least one of their composition or density.

5. The electrical apparatus according to claim 1, wherein a condensation temperature is lower than a condensation temperature of the insulation fluid.

6. The electrical apparatus according to claim 1, wherein the evaporator is surrounded by the insulation space and comprises an evaporator wall enclosing an evaporator interior space separated from the insulation space, said evaporator wall being impermeable for both the insulation fluid and the cooling fluid.

7. The electrical apparatus according to claim 1, wherein the cooling fluid has a boiling point lower than a maximally allowed hotspot temperature at the at least one winding.

8. The electrical apparatus according to claim 1, wherein the cooling fluid has a boiling point lower than 100° C., at a maximum pressure expected inside the electrical apparatus, during standard operation of the electrical apparatus.

9. The electrical apparatus according to claim 8, wherein the maximum pressure expected inside the electrical apparatus, during standard operation of the electrical apparatus is 6 bar at most.

10. The electrical apparatus according to claim 1, wherein the first organofluorine compound is selected from the group consisting of hydrofluoromonoethers, perfluoroketones, hydrofluoroolefins, and perfluoronitriles, and mixtures thereof, and wherein the second organofluorine compound is selected from the group consisting of hydrofluoromonoethers, perfluoroketones, hydrofluoroolefins, and perfluoronitriles, and mixtures thereof.

11. The electrical apparatus according to claim 1, wherein the first organofluorine compound and the second organofluorine compound comprise the same organofluorine compound.

12. The electrical apparatus according to claim 1, wherein the cooling fluid is at least approximately devoid of air or an air component.

13. The electrical apparatus according to claim 1, wherein the background gas is selected from the group consisting of: air, an air component, nitrogen, oxygen, carbon dioxide, a nitrogen oxide, and mixtures thereof.

14. The electrical apparatus according to claim 1, wherein a second pressure of the cooling fluid in the evaporator is at least approximately equal to a first pressure of the insulation fluid in the insulation space.

15. The electrical apparatus according to claim 1, wherein the condenser is arranged outside of the apparatus, and is configured to transfer heat to the outside of the electrical apparatus.

16. The electrical apparatus according to claim 1, further comprising an auxiliary cooling element allocated to the condenser.

17. The electrical apparatus according to claim 1, further comprising a cooling fluid recirculation channel fluidically connecting the condenser and the evaporator, wherein the cooling fluid recirculation channel allows a flow of the condensed cooling fluid from the condenser in direction to the evaporator.

18. The electrical apparatus according to claim 17, wherein the cooling fluid recirculation channel is disposed in a cooling fluid outlet region branching off from the condenser and arranged outside of the apparatus.

19. The electrical apparatus according to claim 1, wherein the electrical apparatus comprises one of a gas-insulated transformer or a gas-insulated reactor.

20. The electrical apparatus according to claim 1, wherein the cooling fluid forms a dielectric insulating material.

21. The electrical apparatus according to claim 1, wherein the immersed part of the electrical component is a bare or barely insulated part configured to produce heat upon exposure to electric or magnetic fields.

22. The electrical apparatus according to claim 1, wherein the cooling element comprises a heat sink.

23. The electrical apparatus according to claim 1, further comprising means for creating a turbulent flow of the liquid cooling fluid inside the cooling element.

24. The electrical apparatus according to claim 23, wherein the means are or are part of the immersed part of the electrical component.

25. A method of cooling a fluid-insulated electrical apparatus, comprising:

a housing enclosing an interior space, in which interior space an electrical component comprising at least one winding is arranged, at least a portion of the interior space defining an insulation space;

an insulation fluid disposed within the insulation space and electrically insulating at least a part of the electrical component from the housing, the insulation fluid comprising a first organofluorine compound and a background gas, wherein the first organofluorine compound is selected from the group consisting of fluoroethers, fluoroketones, fluoroolefins, fluoronitriles, and mixtures thereof;

a cooling element comprising a condenser, an evaporator and a cooling fluid to be circulated between the condenser and the evaporator, the evaporator being configured such that at least a part of the electrical component is immersed in the cooling fluid in its liquid state, thus being in direct contact with the cooling fluid, the cooling fluid consisting of second organofluorine compound selected from the group consisting of fluoroethers, fluoroketones, fluoroolefins, fluoronitriles, and mixtures thereof, wherein the cooling fluid is devoid of a background gas, wherein the insulation fluid has a first condensation temperature and the cooling fluid has a second condensation temperature lower than the first condensation temperature, the method comprising:

transferring heat in the evaporator from the electrical component to the cooling fluid, at least a portion of which cooling fluid being in its liquid state, in which liquid cooling fluid at least a part of the electrical component immersed, whereby at least a portion of the liquid cooling fluid evaporates;

transferring the evaporated cooling fluid to the condenser;

cooling down the evaporated cooling fluid below the condensation temperature, thereby causing the evaporated cooling fluid becoming liquid;

transferring the liquid cooling fluid back to the evaporator; and repeating the transferring heat, the transferring the evaporated cooling fluid, the cooling down the evaporated cooling fluid, and the transferring the liquid cooling fluid to transfer heat away from the electrical component.

26. The method according to claim 25, wherein transferring the liquid cooling fluid further comprises creating a turbulent flow of the liquid cooling fluid inside the cooling element around the immersed part of the electrical component.

27. A fluid-insulated electrical apparatus comprising:

a housing enclosing an interior space, in which interior space an electrical component comprising at least one winding is arranged, at least a portion of the interior space defining an insulation space;

an insulation fluid disposed within the insulation space and electrically insulating at least a part of the electrical component from the housing, the insulation fluid comprising a first organofluorine compound and a background gas, wherein the first organofluorine compound is selected from the group consisting of fluoroethers, fluoroolefins, fluoronitriles, and mixtures thereof; and a cooling element comprising a condenser, an evaporator and a cooling fluid to be circulated between the condenser and the evaporator, the evaporator being configured such that at least a part of the electrical component is immersed in the cooling fluid in its liquid state, thus being in direct contact with the cooling fluid, the cooling fluid consisting of second organofluorine compound selected from the group consisting of fluoroethers, fluoroolefins, fluoronitriles, and mixtures thereof, wherein the cooling fluid is devoid of a background gas, and wherein the insulation fluid has a first condensation temperature and the cooling fluid has a second condensation temperature lower than the first condensation temperature.

* * * * *